US006557504B2

(12) United States Patent
Ström et al.

(10) Patent No.: US 6,557,504 B2
(45) Date of Patent: May 6, 2003

(54) TWO-STROKE INTERNAL COMBUSTION ENGINE

(75) Inventors: Hans Ström, Kode (SE); Bo Carlsson, Floda (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 10/194,697

(22) Filed: Jul. 12, 2002

(65) Prior Publication Data

US 2003/0010297 A1 Jan. 16, 2003

Related U.S. Application Data

(63) Continuation of application No. PCT/SE00/00067, filed on Jan. 14, 2000.

(51) Int. Cl.[7] ..... F02B 33/04
(52) U.S. Cl. ..... 123/73 A; 123/73 B; 123/187.5 R
(58) Field of Search ..... 123/73 A, 73 PP, 123/187.5 R

(56) References Cited

U.S. PATENT DOCUMENTS 4,284,040 A 8/1981 Baltz et al.
4,373,479 A 2/1983 Billingsley et al.
4,375,206 A 3/1983 Baltz et al.
4,498,434 A 2/1985 Baltz et al.
5,031,590 A 7/1991 Sakurai
5,241,931 A 9/1993 Radel

OTHER PUBLICATIONS

Kogyo K.K. Sanshin and Takayasu Hidekazu, "Starting Fuel Increasing Device for Internal Combustion Engine", May 1984, vol. 10 No. 126 (M–477) 1 page.

Sakurai Yoshihiro and Sanshin Ind. Co., Ltd., "Fuel Feeding Device for Internal Combustion Engine", Aug. 1984, vol. 10 No. 222 (M–504) 1 page.

*Primary Examiner*—Noah P. Kamen
(74) *Attorney, Agent, or Firm*—Pearne & Gordon LLP

(57) ABSTRACT

A two-stroke internal combustion engine comprising a cylinder (10; 50) with a movable piston (11; 52) in it, which cylinder at its one end has a combustion chamber (16; 51) and at its other end is connected to a crankcase (15; 53). The crankcase and the combustion chamber are mutually connected via a scavenging duct (17; 56), whose opening and closing is controlled by the movement of the piston, and a carburetor (20; 55) is via an inlet port (21) connected to the crankcase. In order to simplify starting the engine it is provided with a device (23–6; 61–65; 70–72) for supply of fuel to the scavenging duct (17; 56) adjacent the combustion chamber.

15 Claims, 4 Drawing Sheets

TWO-STROKE INTERNAL COMBUSTION ENGINE

This application is a continuation of international application No. PCT/SE00/00067 filed on Jan. 14, 2000.

TECHNICAL FIELD

The subject invention refers to a two-stroke internal combustion engine comprising a cylinder with a movable piston in it, which cylinder at its one end has a combustion chamber and at its other end is connected to a crankcase, whereby the crankcase and the combustion chamber are mutually connected via a scavenging duct, whose opening and closing is controlled by the movement of the piston, and a carburetor is via an inlet port connected to the crankcase.

BACKGROUND OF THE INVENTION

In a conventional two-stroke internal combustion engine an air/fuel mixture is led from the carburetor to the crankcase and from there via one or several scavenging ducts to the combustion chamber. The path from the carburetor to the combustion chamber will thereby become relatively long. Furthermore, the crankcase has a volume, which is approximately five times as large as the cylinder volume. Besides that, in order to reach the combustion chamber the fuel must be vaporized. When starting the engine this means, particularly when the engine is cold, that the engine's crankcase must rotate a lot before a combustible air/fuel mixture will reach the combustion chamber. Starting the engine thus requires more time and effort than what would be desirable. This is a disadvantage, particularly when the engine has a manually operated starter device, such as a cord starter device, but also when the engine is equipped with a starter.

The purpose of the subject invention is to eliminate or at least reduce the above-mentioned disadvantage and to achieve a two-stroke engine having an essentially improved startability. This is achieved in an internal combustion engine of the kind mentioned initially, and which in accordance with the invention is mainly characterized in that it comprises a device for supply of fuel to the scavenging duct adjacent to the combustion chamber in order to simplify starting of the engine.

BRIEF DESCRIPTION OF THE DRAWINGS

The invention will be described in closer detail in the following with reference to the accompanying drawing figures, in which.

DESCRIPTION OF EXAMPLE EMBODIMENTS

Figure 1:
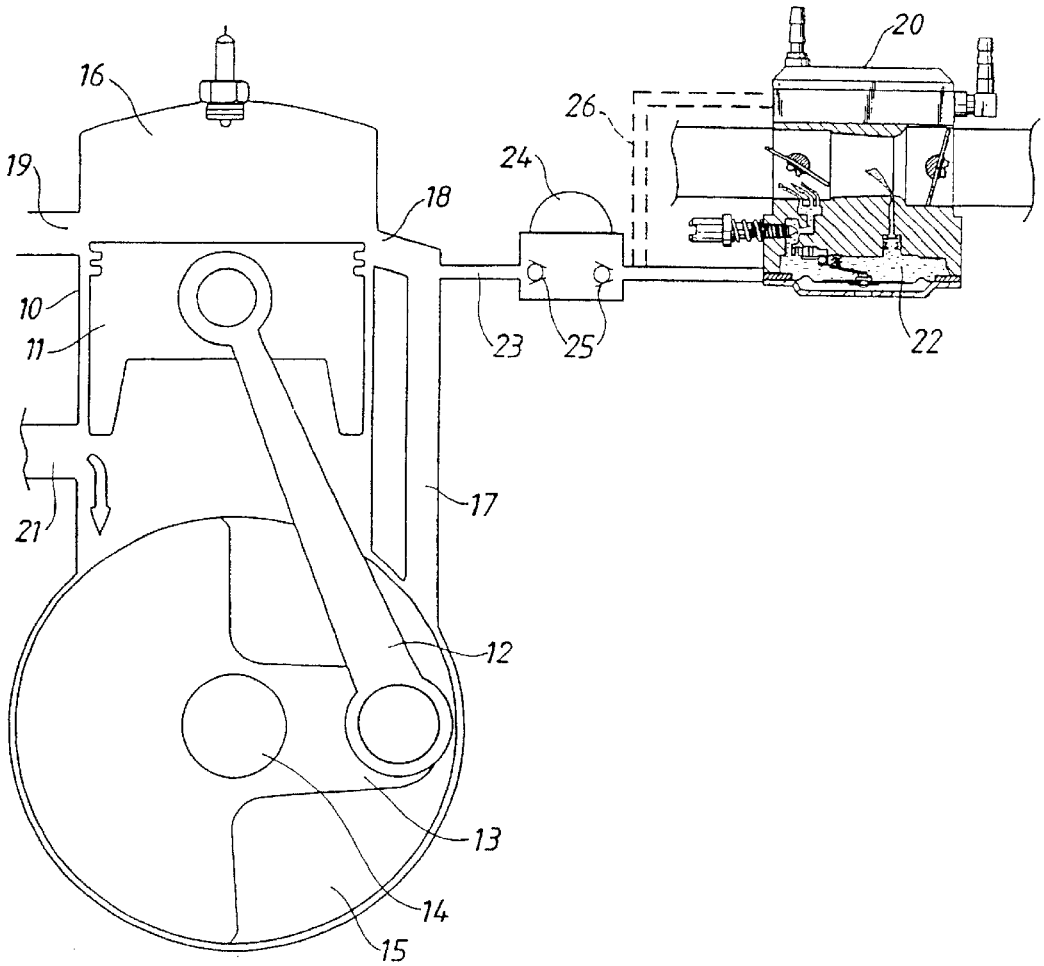
FIG. 1 illustrates a schematic cross-sectional view of a two-stroke engine with crankcase scavenging and provided with a first embodiment of a device according to the invention for improving the engine's startability.

The engine, shown in FIG. 1, comprises a cylinder 10 with a movable piston 11 in it. Via a connecting rod 12 the piston 11 is connected to a crank mechanism 13 mounted to a crankshaft 14 and rotatable in a crankcase 15. A combustion chamber 16 located above the piston 11 is connected to the crankcase 15 via a scavenging duct 17, which debouches into the combustion chamber via a piston ported scavenging port 18. The combustion chamber 16 also has a piston ported exhaust port 19 through which the combustion gases are conducted to an exhaust gas system, which is not shown here.

A carburetor 20 is connected with a piston ported inlet port 21, through which a mixture of air/fuel is forwarded to the crankcase 15. The carburetor 20 is a diaphragm carburetor of the conventional type and will therefore not be described in closer detail.

The metering chamber 22 of the carburetor 20 is by means of a fuel pipe 23 connected to the scavenging duct 17. The fuel pipe 23 is provided with a manually activated pump 24 with check valves 25. Alternatively the fuel pipe could be connected to the carburetor's fuel inlet side, as shown by dashed lines by numeral reference 26.

When starting the engine a smaller amount of fuel is injected into the scavenging duct 17 in that the operator activates the pump 24 manually. When the engine rotates, this amount of fuel will during the scavenging process be brought together with the scavenging gases directly into the combustion chamber 16 without first having to pass through the crankcase. Fuel is thus added into the combustion chamber broadly without delay, when the engine rotates. Thereby a combustible air/fuel mixture is rapidly achieved in the combustion chamber. The number of revolutions that are required for starting the engine will therefore be reduced considerably. It should be obvious that this will simplify the starting, in particular when the engine is cold.

Figure 2:
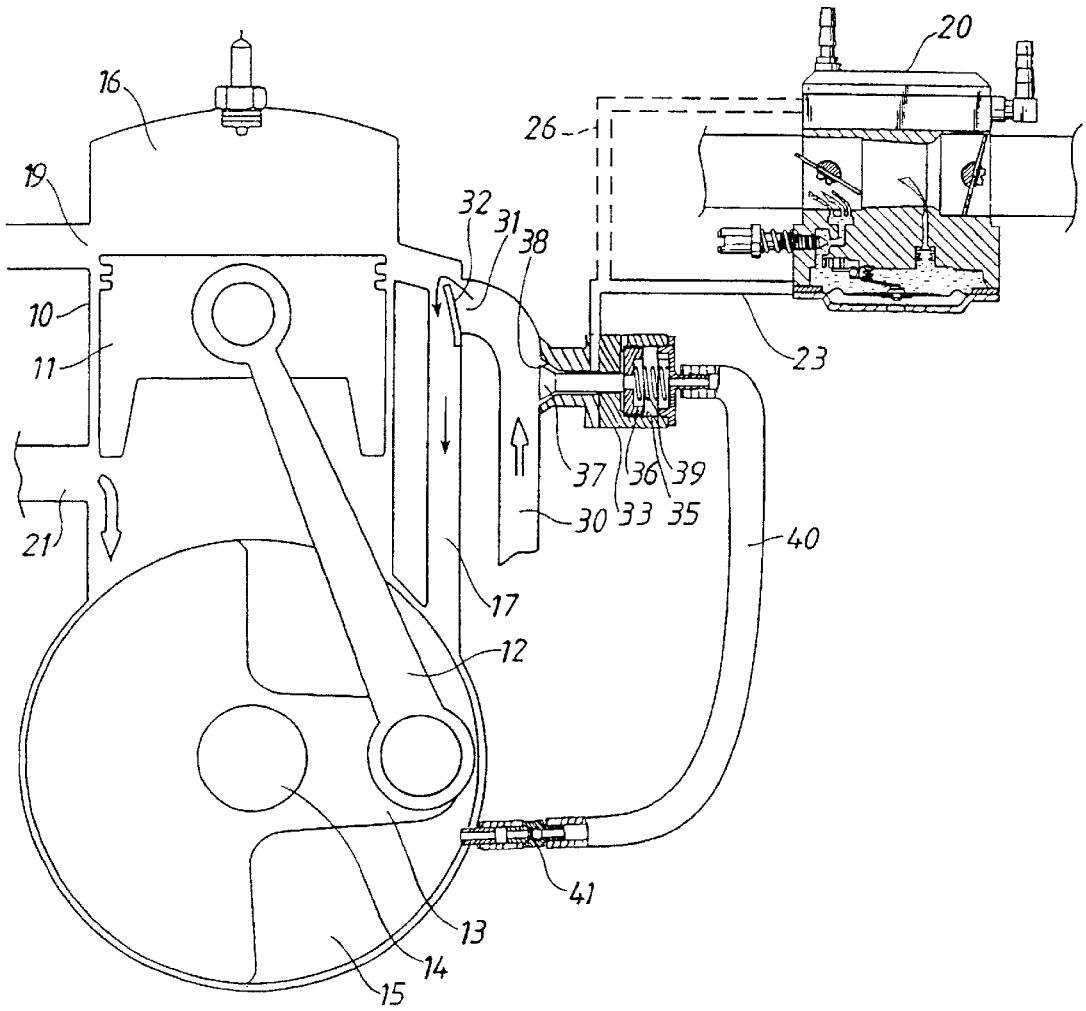
FIG. 2 shows a corresponding schematic view of a two-stroke engine provided with a second embodiment of the device according to the invention.

In the shown embodiment according to FIG. 2 the corresponding parts of the engine and the carburetor have been given the same numeral references as in FIG. 1. The engine in this embodiment is provided with a device for automatic supply of starting fuel to the combustion chamber 16, said device is thus not requiring any user operation. In order to reduce the scavenging losses the engine has an air duct 30, which is connected to the scavenging duct 17 close to its upper end. The air duct 30 debouches into the scavenging duct 17 via an aperture 31, which is controlled by a check valve 32. Via the air duct 30 atmospheric air is sucked into the scavenging duct 17, as shown by arrows in the figure. During the initial phase of the scavenging process a pre-scavenging of the combustion chamber with atmospheric air is thereby achieved, which reduces the losses of unburned air/fuel mixture via the exhaust port 19.

When starting the engine fuel is forwarded from the carburetor 20 via the fuel pipe 23 or 26 to the air duct 30. The supply of fuel is controlled by a valve, which generally is designated by numeral reference 33. The valve 33 comprises a cylinder 35 with a movable piston 36 in it, said piston is connected to a conical valve body 37, which cooperates with a valve seat 38. In the cylinder 36 there is a compression spring 39, which strives to switch over the valve to the shown, opened position. By means of a duct 40 (not shown) the inside of the cylinder 35 is connected with the crankcase 15. The duct 40 is provided with a check valve 41. Preferably a temperature-sensitive valve, which is not shown here, is arranged at the inlet of the pipe 23 to the valve 33 in order to shut off the fuel flow to the valve 33, when the engine is warm. E.g. the temperature-sensitive valve could consist of a bimetal spring, which opens and closes the inlet to the valve 33.

When the crankshaft is rotated to start the engine, fuel is sucked from the carburetor 20 into the air duct 30 via the valve 33, which is kept in an opened position by the spring 39. By way of the air flow the fuel is forwarded into the air duct 30 via the check valve 32 to the scavenging duct 17, and thereafter, during the following scavenging phase further on into the combustion chamber 16, in order to simplify starting the engine. When the engine has started, the duct 40 will be evacuated during the under-pressure phase in the crankcase 15, whereby an under-pressure in the cylinder 35 is created, which affects the piston 36 to shut the valve body 37 against the action of the spring 39. The check valve 41 will prevent an over-pressure from the compression phase in the crankcase from reaching the valve 33, which therefore will be closed as long as the engine is running. When the engine has stopped, the valve body 37 will be moved to the opened position by the spring 39, whereby the valve 33 automatically resets into the starting position.

Figure 3:
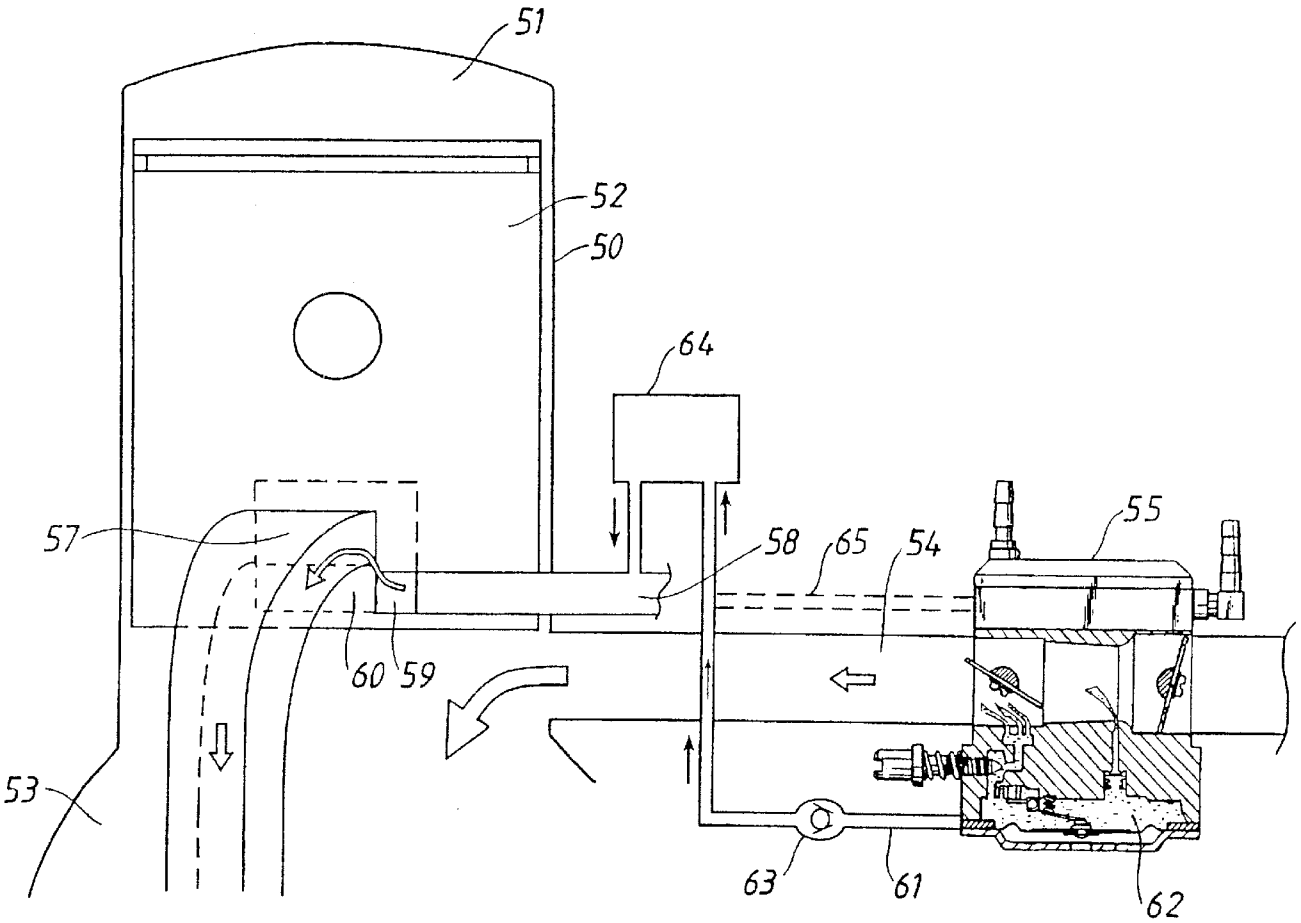
FIG. 3 shows a schematic view of a two-stroke engine provided with a third embodiment of the device according to the invention.

The two-stroke engine, as shown schematically in FIG. 3, has a cylinder 50 with a combustion chamber 51, a piston 52 and a crankcase 53, which via an inlet duct 54 is connected with a carburetor 55. A scavenging duct 56 debouches into the cylinder via a scavenging port 57. The engine has a device for prescavenging of the combustion chamber with atmospheric air, comprising an air duct 58, which debouches into the cylinder via an aperture 59. The piston 52 has a recess 60, which is shown by dashed lines, and through which the aperture is connected with the scavenging port 57, when the piston is in the shown position. As marked by arrows in the figure, atmospheric air will in this position flow via the air duct 58 into the scavenging duct 56. During the following scavenging phase the scavenging will in an initial phase take place with atmospheric air from the scavenging duct 56.

In order to simplify starting the engine a fuel pipe 61 is arranged from the metering chamber 62 of the carburetor 55, which fuel pipe via a check valve 63 and a control unit 64 debouches into the air duct 58. Alternatively, the fuel pipe could be connected to the inlet side of the carburetor 55, as shown by dashed lines by numeral reference 65. When starting the engine fuel is added via the pipe 61 into the air duct 58, whereby the supply of fuel is controlled by way of control unit 64. For control of the supply of fuel several alternatives are conceivable. E.g. the control unit 64 could consist of rotational speed sensors, which sense the rotational speed of the crankshaft and will shut off the fuel supply, when the engine has started. Another possibility is to use pressure sensors, which control the supply of fuel, depending on the pressure in the combustion chamber 51, the crankcase 53 or the inlet duct 54. The control unit could also contain temperature sensors, which prevent the supply of fuel when starting a warm engine. It is also possible to carry out the control solely by way of temperature sensors.

Figure 4:
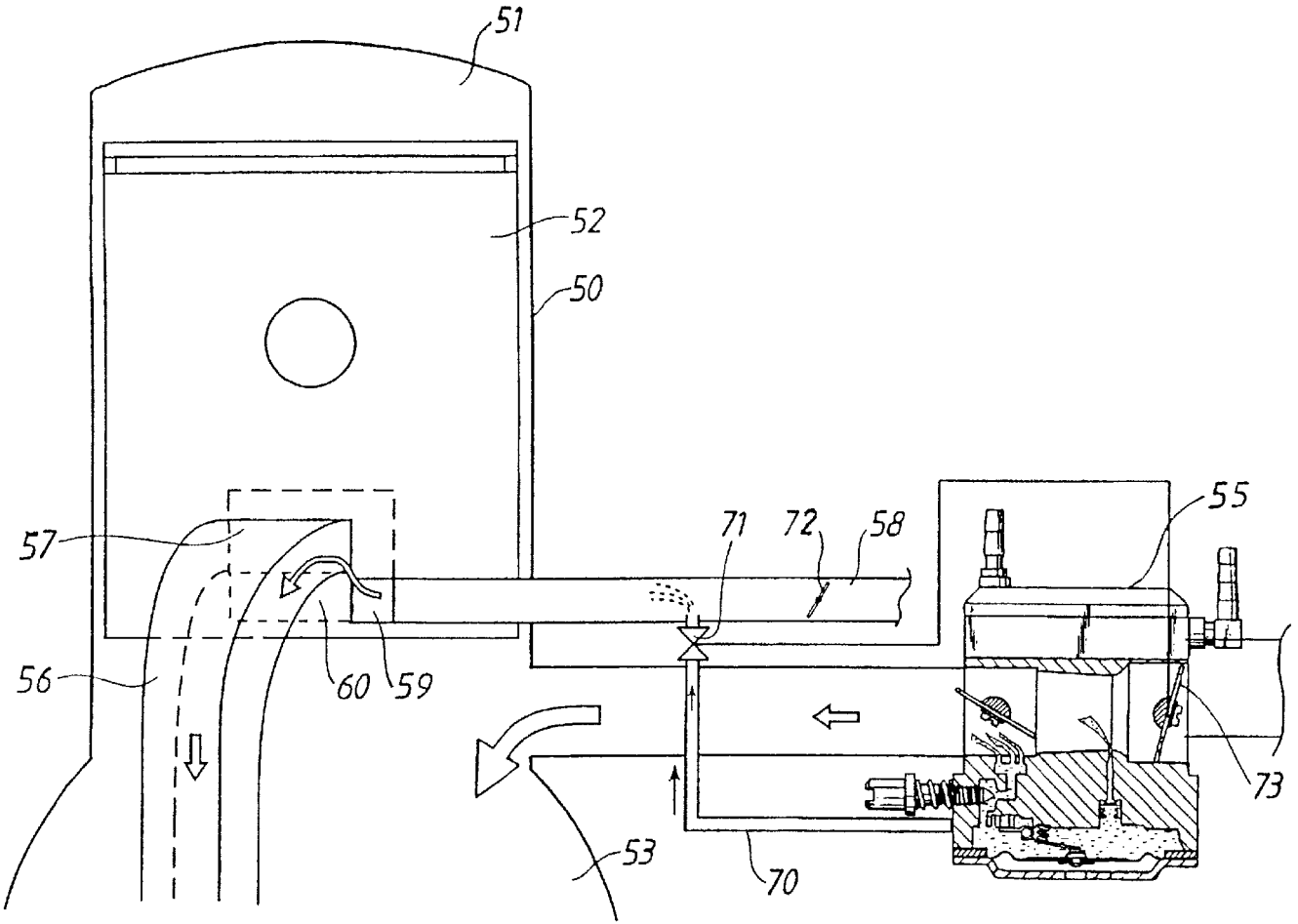
FIG. 4 is a schematic view of a two-stroke engine provided with a fourth embodiment of the device according to the invention.

The engine shown in FIG. 4 mainly corresponds to the engine in FIG. 3, and it has been given the same numeral references. In order to simplify starting the engine fuel is led from the carburetor into the air duct 58 via a fuel pipe 70, which is provided with a valve 71. The air duct 58 has a restriction valve 72, which is located in front of the outlet of the fuel pipe in this duct, seen from the flow direction. The valve 71 and the restriction valve 72 are by means of control units, which are not shown here, connected to the starting valve 73 of the carburetor.

When starting the engine the starting valve 73 of the carburetor is set into the starting position, as shown in the figure, whereby the valve 71 is opened and the restriction valve is set into the shown position, where the air duct 58 is restricted. When the engine is rotated, fuel will be sucked into the air duct 58 from the pipe 70 and forwarded by the air flow into the scavenging duct 56 and then, during the scavenging process, further on to the combustion chamber 51. This means that a rich air/fuel mixture is forwarded to the combustion chamber during the starting process, which simplifies starting the engine. When the engine has started, the starting valve 73 of the carburetor is set into running position, whereby at the same time the valve 71 is closed and the restriction valve is opened. This setting can be made either manually or automatically.

In the examples have been shown some different devices, which all during the starting process are supplying fuel to at least one scavenging duct. The examples show three somewhat different types of two-stroke engines. Each one of the shown devices can be combined with each one of the shown types of engines.

What is claimed is:

1. A two-stroke internal combustion engine comprising;

a cylinder (10; 50);

a movable piston (11; 52) within the cylinder (10; 50), the piston (11; 52) and one end portion of the cylinder (10; 50) bounding a combustion chamber (16; 51);

a crankcase (15; 53) connected to a second end portion of the cylinder (10; 50);

a scavenging duct (17; 56) connected to the crankcase (15; 53) and the combustion chamber (16; 51), the scavenging duct (17; 56) being opened and closed in response to movement of the piston;

a carburetor (20; 55) connected to the crankcase (15; 53) via an inlet port (21);

an air duct (30; 58, 59, 60) for supply of atmospheric air to the scavenging duct (17; 56) to achieve a prescavenging of the combustion chamber with atmospheric air reducing the losses of unburned air/fuel mixture via an exhaust port; and a fuel pipe (23; 61, 70) for supplying fuel from the carburetor (20) to the air duct (30; 58, 60) during an engine start-up period in order to simplify starting of the engine.

2. An engine as set forth in claim 1, wherein the air duct (58, 60) is connected with the cylinder (10; 50) at an aperture (59), the scavenging duct (17; 56) is connected with the cylinder (10; 50) at a scavenging port (57), and the piston (52) has a recess (60) that permits communication between the aperture (59) and the scavenging port (57) when the piston (52) is located at or adjacent to the one end portion of the cylinder (10; 50).

3. An engine as set forth in claim 1, including a pump (24) associated with the fuel pipe (23; 61; 70) for the supply of fuel from the carburetor (20; 55) to the air duct (30; 58, 60).

4. An engine as set forth in claim 1, including a control unit (64) for controlling the supply of fuel to the air duct (58; 30), the control unit (64) including a device for sensing at least one of engine rotational speed, pressure, and temperature.

5. An engine as set forth in claim 1, including a valve (33) operatively connected to the fuel pipe (23; 61, 70) to shut off the supply of fuel to the air duct (30; 58, 60) subsequent to the engine start-up period.

6. An engine as set forth in claim 5, wherein the valve (33) is connected with an engine pressure source and is operationally responsive to pressure variation.

7. An engine as set forth in claim 6, wherein the engine pressure source is the crankcase (15).

8. An engine as set forth in claim 1, including a valve (71) for controlling the supply of fuel to the air duct (58; 30), which is arranged to be set depending on the carburetor's (55; 20) setting between starting and running positions.

9. An engine as set forth in claim 1, including a restriction valve (72), located within the air duct (58), which is arranged to be set depending on the carburetor's (55; 20) setting between starting and running positions.

10. A two-stroke internal combustion engine comprising;

a cylinder (10; 50);

a movable piston (11; 52) within the cylinder (10; 50), the piston (11; 52) and one end portion of the cylinder (10; 50) bounding a combustion chamber (16; 51);

a crankcase (15; 53) connected to a second end portion of the cylinder (10; 50);

a scavenging duct (17; 56) connected to the crankcase (15; 53) and the combustion chamber (16; 51), the scavenging duct (17; 56) being opened and closed in response to movement of the piston;

a carburetor (20; 55) connected to the crankcase (15; 53) via an inlet port 12 (21);

an air duct (30; 58, 59, 60) for supply of atmospheric air to the scavenging duct (17; 56) to achieve a pre-scavenging of the combustion chamber with atmospheric air reducing the losses of unburned air/fuel mixture via an exhaust port; and a fuel pipe (23; 61, 70) for supplying fuel from the carburetor (20) to the air duct (30; 58, 60) during an engine start-up period in order to simplify starting of the engine;

wherein the air duct (58, 60) is connected with the cylinder (10; 50) at an aperture (59), the scavenging duct (17; 56) is connected with the cylinder (10; 50) at a scavenging port (57), and the piston (52) has a recess (60) that permits communication between the aperture (59) and the scavenging port (57) when the piston (52) is located at or adjacent to the one end portion of the cylinder (10; 50).

11. An engine as set forth in claim 10, including a pump (24) associated with the fuel pipe (23; 61; 70) for the supply of fuel from the carburetor (20; 55) to the air duct (30; 58, 60).

12. An engine as set forth in claim 10, including a control unit (64) for controlling the supply of fuel to the air duct (58; 30), the control unit (64) including a device for sensing at least one of engine rotational speed, pressure, and temperature.

13. An engine as set forth in claim 10, including a valve (33) operatively connected to the fuel pipe (23; 61, 70) to shut off the supply of fuel to the air duct (30; 58, 60) subsequent to the engine start-up period.

14. An engine as set forth in claim 10, including a valve (71) for controlling the supply of fuel to the air duct (58; 30), which is arranged to be set depending on the carburetor's (55; 20) setting between starting and running positions.

15. An engine as set forth in claim 10, including a restriction valve (72), located within the air duct (58), which is arranged to be set depending on the carburetor's (55; 20) setting between starting and running positions.

* * * * *

UNITED STATES PATENT AND TRADEMARK OFFICE

CERTIFICATE OF CORRECTION

PATENT NO. : 6,557,504 B2
DATED : May 6, 2003
INVENTOR(S) : Ström et al.

It is certified that error appears in the above-identified patent and that said Letters Patent is hereby corrected as shown below:

Title page,
Item [57], ABSTRACT,
Line 10, please delete "(23-6;", and insert therefor -- (23-26; --.

Column 5,
Line 20, please delete "12".

Signed and Sealed this

Twenty-first Day of October, 2003

JAMES E. ROGAN
*Director of the United States Patent and Trademark Office*